US007281530B2

(12) United States Patent
Usui

(10) Patent No.: US 7,281,530 B2
(45) Date of Patent: Oct. 16, 2007

(54) SUPERCHARGING SYSTEM FOR INTERNAL COMBUSTION ENGINE

(75) Inventor: Masayoshi Usui, Numazu (JP)

(73) Assignee: Usui Kokusai Sangyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/066,409

(22) Filed: Feb. 25, 2005

(65) Prior Publication Data

US 2005/0183704 A1 Aug. 25, 2005

(30) Foreign Application Priority Data

Feb. 25, 2004 (JP) ..... 2004-049545
Jan. 13, 2005 (JP) ..... 2005-006085

(51) Int. Cl.

*F02M 25/07* (2006.01)
*F01N 3/10* (2006.01)
*F01N 3/02* (2006.01)
*F01N 5/00* (2006.01)
*F01N 7/20* (2006.01)

(52) U.S. Cl. ..... 123/568.17; 123/568.15; 123/568.11; 123/568.2; 60/605.2; 60/316; 60/319; 60/305; 60/278

(58) Field of Classification Search ..... 60/605.2, 60/278, 316, 319, 276; 123/568.17, 568.18, 123/568.21, 568.11, 568.2
See application file for complete search history.

(56) References Cited

U.S. PATENT DOCUMENTS 1,589,391 A * 6/1926 Herr ..... 60/316
3,306,033 A * 2/1967 Cornelius ..... 60/278
3,657,878 A * 4/1972 Kaufmann, Jr. ..... 60/319
3,712,065 A * 1/1973 Hurst ..... 60/316
3,775,971 A * 12/1973 Gadefelt ..... 60/606
3,857,458 A * 12/1974 Ohtani et al. ..... 60/319
3,948,044 A * 4/1976 Wakita ..... 60/305
3,961,477 A * 6/1976 Grieshaber et al. ..... 60/276
4,100,734 A * 7/1978 Ozaki et al. ..... 123/568.2
4,132,198 A * 1/1979 Masaki et al. ..... 60/276
4,197,703 A * 4/1980 Holmes ..... 60/319
4,418,532 A * 12/1983 Momose et al. ..... 60/316
4,467,774 A * 8/1984 Becker et al. ..... 123/568.11
4,776,168 A 10/1988 Woollenweber (Continued)

FOREIGN PATENT DOCUMENTS

DE 3640290 A1 * 6/1988

(Continued)

*Primary Examiner*—Thai-Ba Trieu
(74) *Attorney, Agent, or Firm*—Jordan and Hamburg LLP

(57) ABSTRACT

A supercharging system for an internal combustion engine includes an exhaust introduction passage for introducing exhaust gas from an internal combustion engine; an exhaust discharge passage for introducing the exhaust gas from the exhaust introduction passage and exhausting the exhaust gas to an exterior; a mixture part arranged between the exhaust introduction passage and the exhaust discharge passage, for changing internal pressure into negative pressure upon accelerating flowing velocity of the exhaust gas with a narrowed flowing passage set to have a smaller diameter than the exhaust introduction pipe; an absorption passage for mixing outside air and the exhaust gas inside the mixture part upon introducing the outside air with use of negative pressure into an inside of the mixture part; and an intake passage for taking out and returning a part of mixed gas mixed inside the mixture part to a side of the internal combustion engine.

5 Claims, 8 Drawing Sheets

U.S. PATENT DOCUMENTS

| | | | | |
|---|---|---|---|---|
| 4,885,911 | A | 12/1989 | Woollenweber et al. | |
| 4,918,923 | A | 4/1990 | Woollenweber et al. | |
| 5,271,221 | A * | 12/1993 | Lyon | 60/278 |
| 6,739,845 | B2 | 5/2004 | Woollenweber | |
| 2003/0123768 | A1 | 7/2003 | Woollenweber | |
| 2004/0200215 | A1 | 10/2004 | Woollenweber et al. | |
| 2006/0021327 | A1 * | 2/2006 | Kiser et al. | 60/278 |

FOREIGN PATENT DOCUMENTS

| | | | |
|---|---|---|---|
| DE | 4422966 | C1 * | 5/1995 |
| JP | 53040120 | A * | 4/1978 |
| JP | 56088910 | A * | 7/1981 |
| JP | 59119009 | A * | 7/1984 |
| JP | 60-237153 | | 11/1985 |
| JP | 2-43421 | | 3/1990 |
| JP | 06221229 | A * | 8/1994 |
| JP | 11-62632 | | 3/1999 |
| JP | 11-108578 | | 4/1999 |
| JP | 11-182358 | | 7/1999 |
| JP | 2003-286871 | | 10/2003 |
| KR | 2002009005 | A * | 2/2002 |

* cited by examiner

SUPERCHARGING SYSTEM FOR INTERNAL COMBUSTION ENGINE

BACKGROUND OF THE INVENTION

1. Field of the Invention

This invention relates to a supercharging system for an internal combustion engine in which a part of exhaust is mixed with intake air and returned to the internal combustion engine.

2. Description of Related Art

Conventionally, EGR systems in which a part of exhaust gas is taken out of an exhaust gas system and returned to an intake system of the engine to be added to mixture gas and intake air, such as disclosed in, e.g., Japanese Unexamined Patent Publication Nos. S60-237,153, H11-62,632, H11-182,358, and 2003-286,871, have been used in engines for automobiles along with gasoline engines and diesel engines. The EGR system has a supercharger such as, e.g., a turbocharger or the like, in which a turbine of the turbocharger is driven by the exhaust gas exhausted from the internal combustion engine to render the compressor rotate to take in and compress outside air, and the compressed air is then supplied into the internal combustion engine, e.g., an engine and so on after cooled down with an intercooler. At a time of this supply, a part of the exhaust gas is taken out of the internal combustion engine to be mixed with the intake gas, and thereafter returned as an EGR gas to the internal combustion engine.

The EGR system, particularly the cooled EGR system for diesel engines of high EGR ratio such as disclosed in the Japanese Unexamined Patent Publication No. H11-108,578 has existed, in which an EGR gas cooler for cooling the EGR gas at a high temperature with cooling water, cooling air, refrigerants for automobile air conditioners, or other refrigerant liquid is disposed to reduce nitrogen oxide gas (NOx) in the exhaust gas, to prevent the mileage from becoming inferior, and to prevent functions and durability of the EGR valve from deteriorated due to excessively increased temperature.

With a supercharger such as, e.g., a turbocharger or the like, however, a structure is complicated to result in high costs while ingression of extraneous substances such as, e.g., stones, sands, etc. into a compressor or a turbine, introduction of exhaust gas at excessively high temperature, or the like occasionally causes a component such as, e.g., a bearing, a seal, a shaft, etc. to get damaged, deformed, or stuck, or causes oil to leak, so that maintenance and so on have been troublesome for taking effort and time. Furthermore, the supercharger or an intercooler needs to be formed separately from an EGR gas system, and further the EGR gas system has an EGR gas cooler, so that the EGR system becomes complicated and larger in size.

This invention is to solve the above described problems, and to obtain the supercharging system for the internal combustion engine with a simple structure and plain manufacturing art to allow reduction in product costs as well as improvement of product durability. This invention is further to enable this supercharging system to operate with use of kinetic energy of the exhaust gas, not with use of large electric power, a fuel, etc., to enhance economical efficiency. The invention is even further to enable a recirculation device such as, e.g., the EGR system or the like arranged into the internal combustion engine to reduce in size, weight, etc. and to obtain the product having superior layout property installable in limited space such as, e.g., an engine room as well as having superior durability hardly allowing occurrences of damage or deformation.

SUMMARY OF THE INVENTION

To solve the above problems, this invention comprises an exhaust introduction passage for introducing exhaust gas from an internal combustion engine; an exhaust discharge passage for introducing the exhaust gas from the exhaust introduction passage and exhausting the exhaust gas to an exterior; a mixture part arranged between the exhaust introduction passage and the exhaust discharge passage, for changing internal pressure into negative pressure upon accelerating flowing velocity of the exhaust gas with a narrowed flowing passage set to have a smaller diameter than the exhaust introduction pipe; an absorption passage for mixing outside air and the exhaust gas inside the mixture part upon introducing the outside air with use of negative pressure into an inside of the mixture part; and an intake passage for taking out and returning a part of mixed gas mixed inside the mixture part to a side of the internal combustion engine.

A formation length of the mixture part may be rendered adjustable upon forming the exhaust introduction passage and the exhaust discharge passage as movable in a direction close to or separating from each other.

A small diameter part may be arranged upon forming a front end side of an exhaust introduction pipe arranged with the exhaust introduction passage, wherein the small diameter part may be coupled to a first discharge pipe arranged inside with the flowing passage for the exhaust gas, wherein an inside of the coupling part may be set as the mixture part for mixing the exhaust gas and the outside air, wherein an absorption pipe arranged with the absorption passage opening on an upstream side of the mixture part may be disposed as penetrating and inserted into the exhaust introduction pipe, wherein a second discharge pipe arranged with the flowing passage for introducing a part of the mixed gas mixed in the mixture part may be disposed on a downstream side of the mixture part, as penetrating and inserted into the first discharge pipe, and wherein one flowing passage of either the first or second discharge pipe may be set as the exhaust discharge passage for exhausting the mixed gas to the exterior, while the other flowing passage may be set as an intake passage for returning the mixed gas to the side of the internal combustion engine.

The coupling part between the exhaust introduction pipe and the first discharge pipe may be set as the absorption passage upon arranged with a gap part in communication with the exterior, capable of introducing the outside air into the mixture part.

The small diameter part may be arranged upon forming a front end side of the exhaust introduction pipe arranged with the exhaust introduction passage, wherein the small diameter part may be coupled to the first discharge pipe having a larger inner diameter than an outer diameter of the small diameter part, arranged inside with the flowing passage for the exhaust gas, wherein the gap part in communication with the exterior, capable of introducing the outside air may be arranged between an inner circumference of the first discharge pipe and an outer circumference of the small diameter part, and set as the absorption passage, wherein a downstream side of the absorption passage and the small diameter part may be set as the mixture part for mixing the exhaust gas with the outside air, wherein the second discharge pipe arranged with the flowing passage for introducing a part of the mixed gas mixed in the mixture part may be disposed on a downstream side of the mixture part, as penetrating and inserted into the first discharge pipe, and wherein one flowing passage of either the first or second discharge pipe may be set as the exhaust discharge passage for exhausting the mixed gas to the exterior, while the other flowing passage may be set as the intake passage for returning the mixed gas to the side of the internal combustion engine.

The absorption passage may be connected perpendicularly to a direction of flowing gas to the mixture part, and absorbs the outside air into an inside of the mixture part.

An air cooler may be arranged to the absorption passage to cool down and absorb the outside air.

A compressor is arranged to the absorption passage to compress and absorb the outside air.

A compressed air introduction pipe for compressing with the compressor and introducing the outside air may be arranged to the intake passage to compress and intake the mixed gas.

The compressor may be operated upon connected to a motor for driving the compressor.

The compressor may be operated upon connected through a pulley to a driving part in auxiliary machinery of the internal combustion engine.

This invention is thus structured, in which the exhaust gas flowing through the exhaust introduction passage flows into the mixture part having the flow passage of a smaller diameter than the exhaust introduction passage, so that flow velocity of the exhaust gas is accelerated, and thus an inside of the mixture part is rendered under negative pressure. With use of this negative pressure, outside air is absorbed through the absorption passage into an inside of the mixture part, thereby being mixed with the exhaust gas inside the mixture part, so that the mixed gas is exhausted through the exhaust discharge passage to an exterior while a part of the mixed gas, at the same time, is introduced into an inside of the intake passage and returned through the intake passage to the internal combustion engine. Thus, it becomes possible to absorb the outside air and to mix the outside air and the exhaust gas upon recovery of kinetic energy of the exhaust gas, so that energy can be effectively reused to improve the economical efficiency in use of the device. Furthermore, since the turbocharger or the like does not need to be formed, the supercharging system for the internal combustion engine can be obtained with the simple structure and the plain manufacturing art. The mixing action of the outside air and the exhaust gas causes cooling effect on the exhaust gas, so that the intercooler, the EGR gas cooler, or the like does not need to be formed, or even where formed, these coolers in smaller size than conventional coolers can be sufficient.

With this EGR system, a device such as having both supercharging system and the EGR gas cooler can be obtained, so that the number of components can be reduced, and the EGR system can be, e.g., simplified and reduced in size as well as weight. As the result, the products at low price can be obtain upon reduction in manufacturing costs, while the products having the superior layout property installable to the limited space such as, e.g., the engine room or the like can be obtained. Furthermore, the simple structure makes it possible to obtain products having the superior durability, in which any damage nor deformation hardly occurs while maintenance work or the like is easy.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

BEST MODE FOR CARRYING OUT THE INVENTION

The First Embodiment

Figure 1:
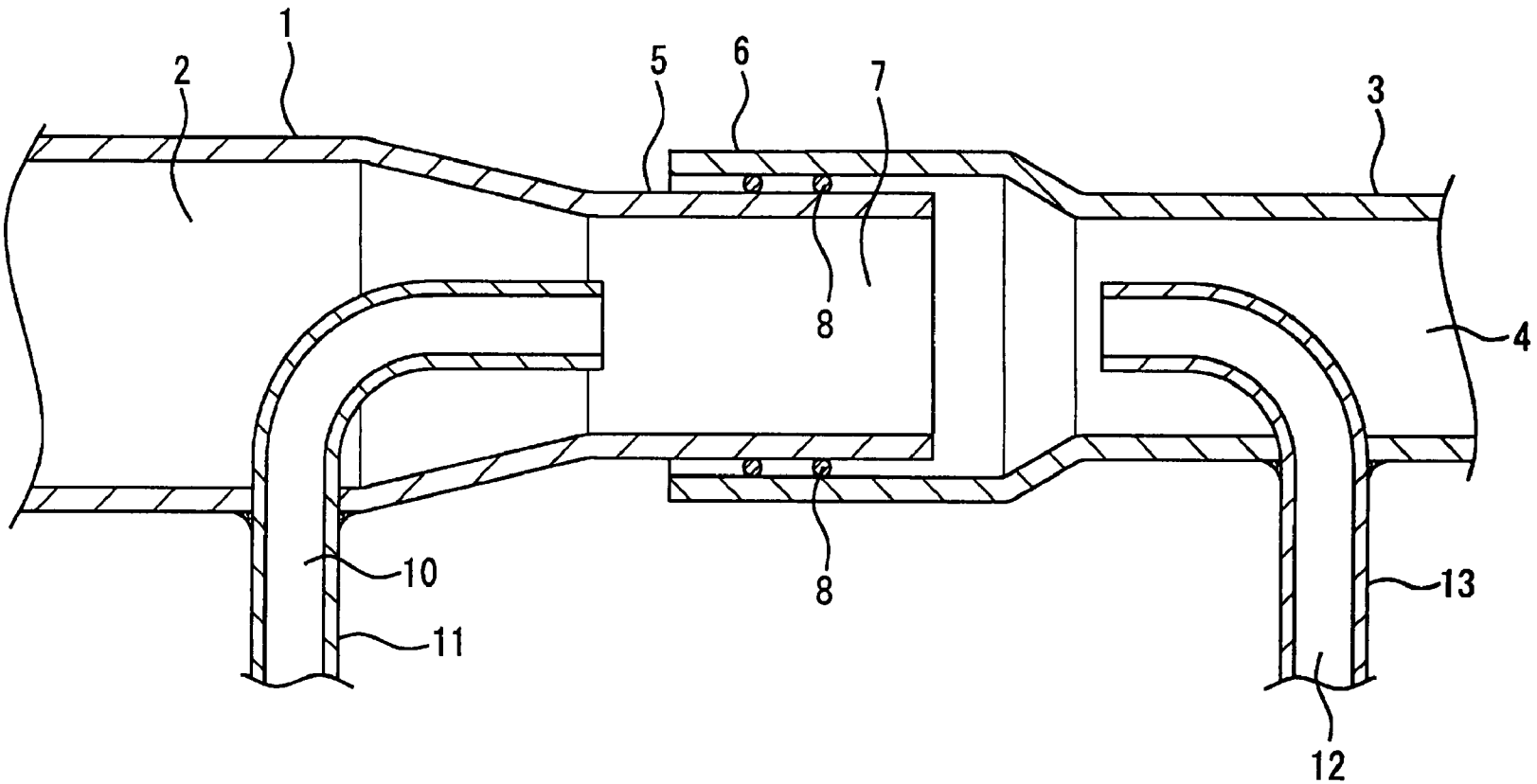
FIG. 1 is a cross-sectional view showing an EGR system arranged with a supercharging system according to the first embodiment of this invention.
Figure 2:
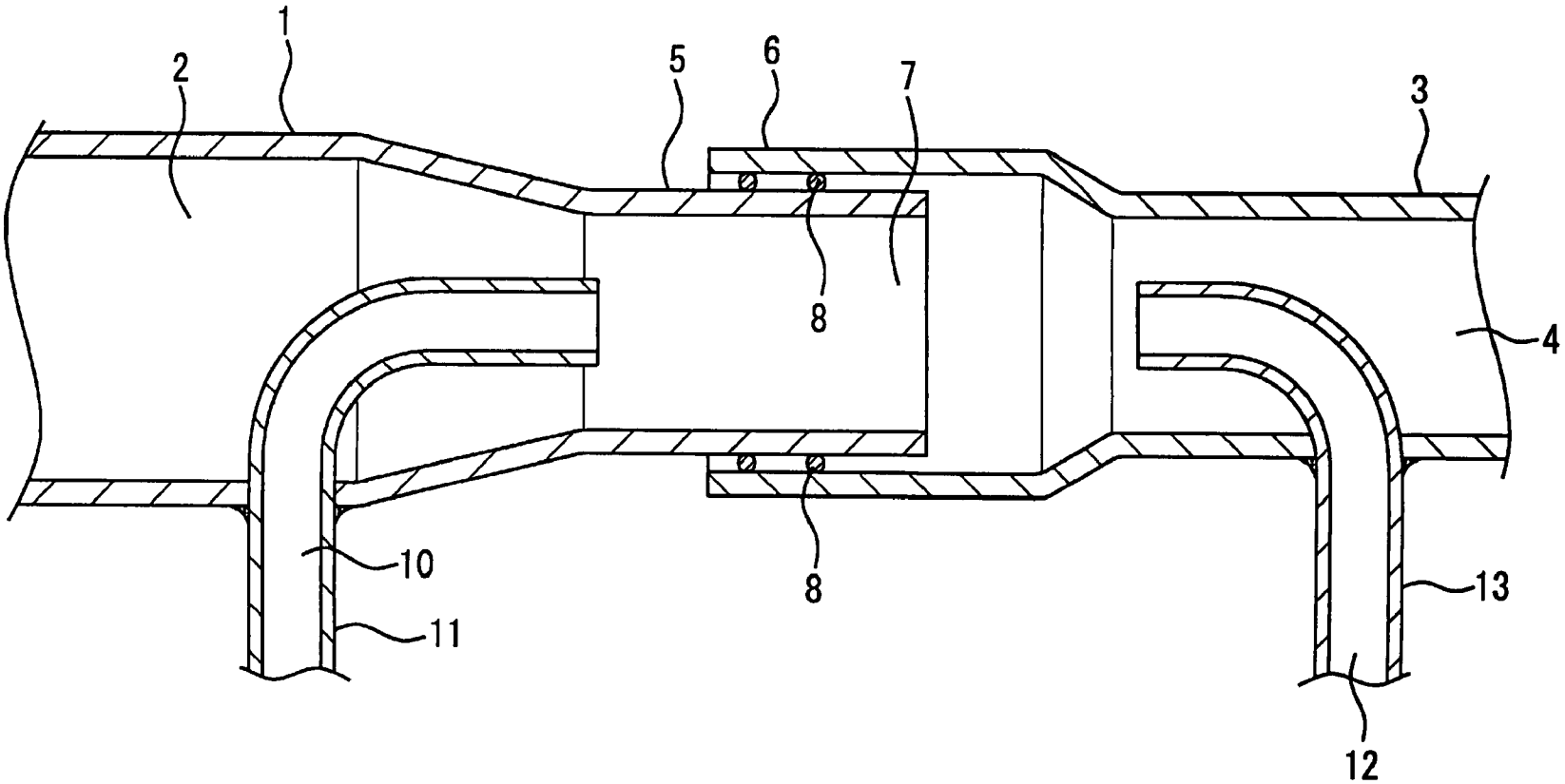
FIG. 2 is a cross-sectional view showing a state where a mixture part is rendered long upon moving an exhaust introduction pipe and an exhaust discharge pipe in a separating direction.

Hereinafter, the first embodiment in which this invention is applied to an EGR system for automobiles is described in reference to FIG. 1 and FIG. 2. Numeral 1 is an exhaust introduction pipe arranged inside with an exhaust introduction passage 2 through which exhaust gas flows after flowing out of an exhaust manifold. A front end of the exhaust introduction pipe 1 is connected in series with a discharge outlet pipe 3 arranged with an exhaust discharge passage 4, in which the exhaust gas flowing through the exhaust introduction pipe is introduced into the exhaust discharge passage 4 and thereafter exhausted through a muffler or the like to an exterior. The first discharge pipe 3 and the exhaust introduction pipe 1 are connected since a front end side of the exhaust introduction pipe 1 is formed to have a smaller diameter than a body part thereof and arranged with a small diameter part 5 of a prescribed length, having a smaller diameter than the exhaust introduction passage 2 disposed as inserted into an inside of an insertion part 6 formed to the first discharge pipe 3. The insertion part 6 into which the small diameter part 5 is to be inserted is formed to have a slightly larger diameter than the body part arranged with the exhaust discharge passage 4, thereby enabling the small diameter part 5 to come in contact with a stepped part at a boundary between the insertion part 6 and a body of the first discharge pipe 3, so that excessive insertion of the exhaust introduction pipe 1 into the first discharge pipe 3 can be prevented.

On a connection part between the exhaust introduction pipe 1 and the exhaust discharge passage 4, a space formed between the exhaust introduction passage 2 and the exhaust discharge passage 4, composed of the small diameter part 5 and the insertion part 6 is defined as a mixture part 7 described later, for mixing the exhaust gas with outside air. The small diameter part 5 and the insertion part 6 are set to arbitrarily movable in a pipe axis direction, not fastened as connected to each other, so that as shown in FIG. 1 and FIG. 2, a formation length of the mixture part 7 is rendered arbitrarily adjustable, while an airtight member 8 such as, e.g., a packing or the like is disposed between an outer circumference of the small diameter part 5 and an inner circumference of the insertion part 6 to prevent gas from leaking through mutual connection portions or to prevent the pipe from wearing out due to friction at a time of forward and backward movement as well as to enhance connection stability between the exhaust introduction pipe 1 and the first discharge pipe 3.

An absorption passage 10 for absorbing the outside air is arranged to the exhaust introduction pipe 1. This absorption passage 10 is formed inside an absorption pipe 11 having a front end side bent in letter R shape, and is disposed upon rendering the absorption pipe 11 penetrate as inserted into the exhaust introduction pipe 1. A front end of the absorption pipe 11 is placed as facing an upstream side of the mixture part 7 to supply the absorbed outside air into an inside of the mixture part 7 so the exhaust gas and the outside gas as to be mixable inside the mixture part 7. On the other hand, on the first discharge pipe 3, an intake passage 12 is arranged as facing a downstream side of the mixture part 7. This intake passage 12 is formed inside the second discharge pipe 13 having an front end bent in the letter R shape, and disposed upon rendering the second discharge pipe 13 penetrate as inserted into an inside of the first discharge pipe 3. Thus, the mixed gas (EGR gas) from the mixture part 7 can be introduced to the inside of the intake passage 12, and thereafter returned to an intake manifold, not shown.

With the EGR system thus structured, the exhaust gas exhausted from the exhaust manifold, not shown, passes through the exhaust introduction passage 2 of the exhaust introduction pipe 1, and is to flow into an inside of the exhaust discharge passage 4 of the first discharge pipe 3. In this situation, the exhaust gas flows through the inside of the small diameter part 5, so that a flow passage becomes narrow rapidly to accelerate flow velocity, thereby leading the inside of the mixture part 7 to be under negative pressure. With use of this negative pressure, the outside air is absorbed though the absorption passage 10 disposed as facing the mixture part 7, and introduced into the mixture part 7. Furthermore, the outside air and the exhaust gas flow with flowing force of themselves, in a state of agitated and mixed each other in the mixture part 7, in a direction of the exhaust discharge passage 4. The mixed gas is exhausted through the exhaust discharge passage 4 to the exterior while a part of the exhaust gas flows into the inside of the intake passage 12 of the second discharge pipe 13, disposed as facing an outlet of the mixture part 7, thereby supplied to the intake manifold.

As described above, the formation length of the mixture part 7 can be adjusted by relatively moving in an axis direction the exhaust introduction pipe 1 and the first discharge pipe 3, and therefore exhaust gas concentration can be adjusted to be equal to a prescribed concentration or an intake air temperature at a time when the intake air is returned to the intake manifold can be adjusted. In use of automobiles, the concentration adjustment or the like by means of this length adjustment of the mixture part 7 is at all times implemented with control by an ECU (Electronic Control Unit) based on information from a temperature sensor for, e.g., the exhaust gas or the like, an analysis sensor for NOx, and so on, so that best suited condition corresponding to an operating condition of the engine can be maintained.

For example, when the formation length of the mixture part 7 is rendered shorter, degree of agitation of the outside air and the exhaust gas becomes lower and duration of mixing the outside air and the exhaust gas becomes shorter. Thus, the exhaust gas concentration inside the mixed gas increases, thereby enabling an EGR ratio to increase. Furthermore, when the formation length of the mixture part 7 is rendered longer, the outside air and the exhaust gas are agitated more sufficiently, and the duration of mixing the outside air with the exhaust gas becomes longer. Therefore, the exhaust gas concentration inside the mixed gas reduces, so that the EGR ratio can reduce, while the temperature of the intake air to be returned to the intake manifold can reduce. It is to be noted that in this embodiment, a pipe arrangement is structured based on size adjustment in which the EGR ratio is to be five to seventy percent at a time of the longest to the shortest formation length of the mixture part 7, respectively.

With the EGR system according to this invention, as described above, the outside air can be absorbed upon forming the small diameter part 5 onto the outlet of the exhaust introduction passage 2 and upon recovering the kinetic energy of the exhaust gas flowing through the small diameter part 5, without forming separately the supercharger such as, e.g., the turbocharger and so on likewise the conventional arts, while the outside air and the exhaust gas can be easily agitated and mixed, so that the EGR system having the supercharging system can be obtained with the simple structure and the plain manufacturing art. Conventionally, on a side of the supercharger, after the outside air at the temperature highly raised upon compressed with the turbocharger is cooled down with the intercooler, or after the exhaust gas exhausted in a state of having the high temperature is cooled down with the EGR gas cooler, these outside air and the exhaust gas need to be returned to the intake manifold, thereby causing the EGR system to be complicated, increased in size and weight, and so on. However, according to this invention, the mixing action of the outside air and the exhaust gas with the EGR system causes the cooling effect on the exhaust gas, so that the intercooler, the EGR gas cooler, or the like does not need to be formed, or even where formed, the size can be considerably reduced compared with the conventional coolers, and thus the EGR system can be simplified in the structure and reduced in size and weight. As the result, the products at low price, having superior layout property easily installable to the limited space or the like in automobiles can be obtained.

Conventionally, ingression of extraneous substances into the supercharger or raised temperature easily causes the components such as, e.g., a shaft, a bearing, a seal, and so on to get damaged, deformed, or stuck, or causes oil to leak. However, the supercharging system according to the first embodiment has the simple structure composed of only the pipe arrangement, without using shafts, bearings, etc. while maintaining airtightness as well as preventing the ingression of the extraneous substances such as stones, sands, etc. upon rendering the airtight member 8 intervene onto the connection part between the small diameter part 5 and the insertion part 6. Thus, any damage or deformation due to the extraneous substances or high heat hardly occurs, so that the products having superior durability and maintenance property can be obtained. It is to be noted that upon taking a countermeasure for the ingression of the extraneous substances on the absorption pipe 11 absorbing the outside air, the ingression of the extraneous substances into the EGR system is well prevented to further enhance reliability of the durability.

Furthermore, according to the above described first embodiment, the connection part between the small diameter part 5 and the insertion part 6 maintains the airtightness upon rendering the airtight member 8 intervene, however, as another different embodiment, a gap part (not shown) in communication with the exterior may be arranged between the outer circumference of the small diameter part 5 and the inner circumference of the insertion part 6 upon rendering the inner diameter of the insertion part 6 larger than the outer diameter of the small diameter part 5, or upon arranging unevenness or the like onto the small diameter part 5 so that this gap part as to be set as the absorption passage 10. As described above, where the gap part is arranged, the outside air is absorbed, because of the negative pressurization inside the mixture part 7, not only through the absorption passage 10 arranged to the absorption pipe 11, but also through the absorption passage 10 formed of the gap part to absorb the outside air, so that mixing rate or the cooling effect on the outside air can be enhanced. Accordingly, when the gap part is arranged, it is desirable that the connection part between the small diameter part 5 and the insertion part 6 is covered with a hood member or the like, or supported with a supporting body to prevent the ingression of the extraneous substances through the gap part as well as to enhance supporting stability of, e.g., the exhaust introduction pipe 1, the first discharge pipe 3, and so on to suppress vibration, wobbling, etc.

Furthermore, according to the above described first embodiment, the inside of the first discharge pipe 3 is set as the exhaust discharge passage 4 while the inside of the second discharge pipe 13 is set as the intake passage 12. Correspondingly, as another different embodiment, the inside of the discharge pipe 3 may be set as the intake passage 12 under the condition that the first discharge pipe 3 is connected to a side of the intake manifold, while the inside of the second discharge pipe 13 may be set as the exhaust discharge passage 4 under the condition that the second discharge pipe 13 is connected to, e.g., a muffler or the like. In this case also, the formation length of the mixture part 7 can be changed upon changing the distance to the exhaust discharge passage 4 inside the second discharge pipe 13 disposed as penetrating the first discharge pipe 3 to short or long by relatively moving the exhaust introduction pipe 1 and the first discharge pipe 3 in the axis direction, so that the adjustment of, e.g., the EGR ratio or the like can be easily conducted.

The Second Embodiment

Figure 3:
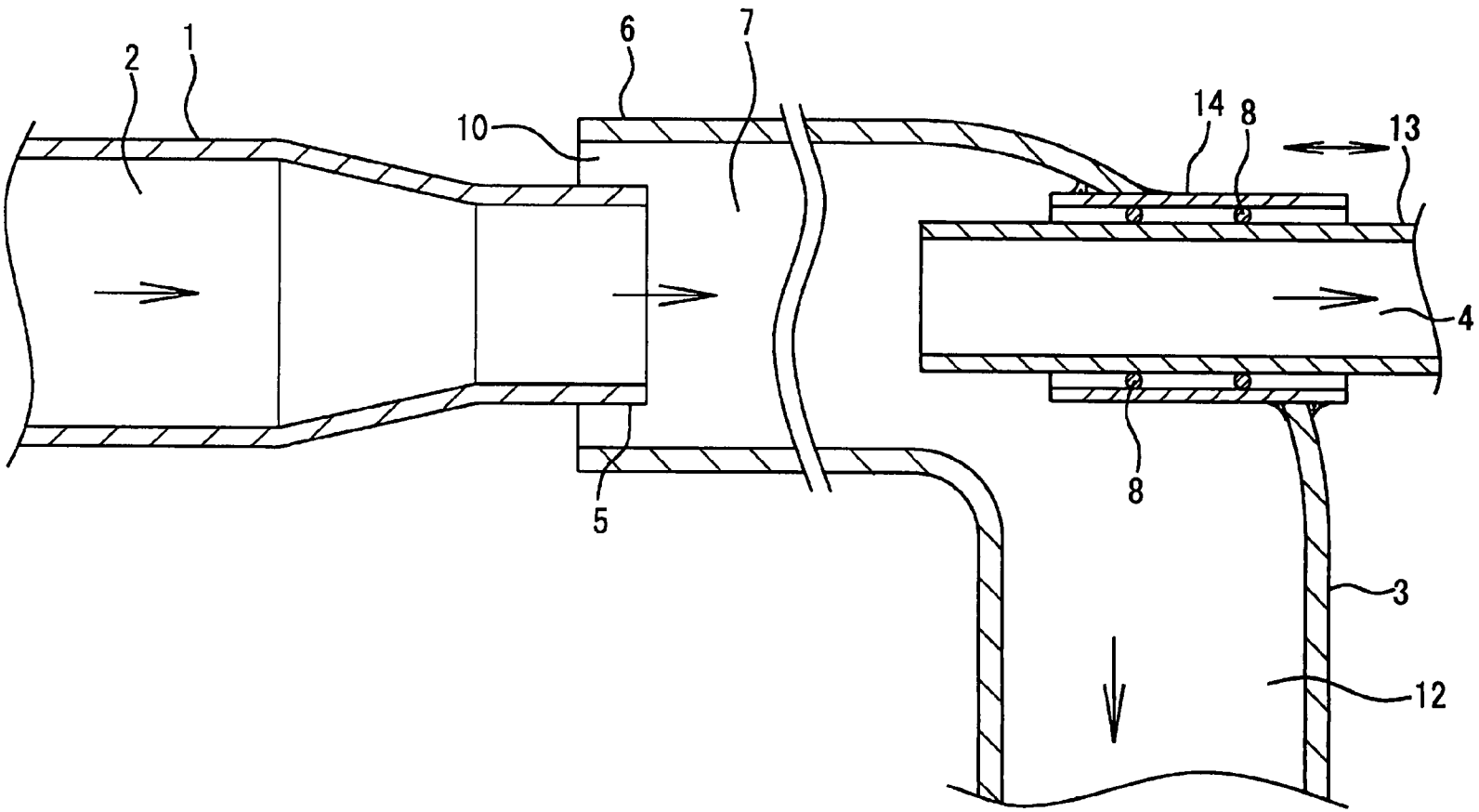
FIG. 3 is a cross-sectional view showing an EGR system arranged with a supercharging system according to the second embodiment of this invention.

In the above described first embodiment, the absorption pipe 11 is disposed separately from the exhaust introduction pipe 1 and the first discharge pipe 3 to arrange the absorption passage 10, however, in another different embodiment, i.e., in the second embodiment, as shown in FIG. 3, the small diameter part 5 of the exhaust introduction pipe 1 is inserted as disposed into the first discharge pipe 3 in letter L shape, having the larger inner diameter than the small diameter part 5. The gap part formed between the small diameter part 5 and the first inlet pipe 3 is set as the absorption passage 10 for absorbing the outside air, and the first inlet pipe 3 is connected to the side of the intake manifold. A holder part 14 in a circular cylinder shape is fastened to around the a bent part of the first discharge pipe 3, in which the exhaust discharge passage 4 for the exhaust gas is arranged inside the holder part 14 while the second discharge pipe 13 to be connected to a side of the muffler is inserted as disposed in a forward and backward movable manner inside the holder part 14, and an inlet of the second discharge pipe 13 is disposed as facing the downstream side of the small diameter part 5 with a prescribed distance. Inside the first discharge pipe 3, an interval between the exhaust introduction pipe 1 and the exhaust discharge passage 4 is set as the mixture part 7 for mixing the exhaust gas with the outside air.

The airtight member 8 is rendered to intervene between the inner circumference of the holder part 14 and the outer circumference of the second discharge pipe 13 inserted as disposed in a forward and backward movable manner into the holder part 14, thereby preventing the ingression of the extraneous substances, the gas leak, the abrasion, and so on while enhancing stability of mutual connection.

With the above described EGR system, since the exhaust gas flowing from the exhaust manifold into the exhaust introduction passage 2 passes through the small diameter part 5 and thus the flow passage becomes narrower, the exhaust gas flows into the inside of the mixture part 7 in a state where the flow velocity is accelerated, so that the inside of the mixture part 7 is rendered under negative pressure. With use of this negative pressure, the outside air is absorbed from the absorption passage 10 formed onto the gap between the small diameter part 5 and the first discharge pipe 3 into the inside of the mixture part 7, and then returned through the intake passage 12 of the first discharge pipe 3 to the side of the intake manifold after mixed with the exhaust gas inside the mixture part 7. It is to be noted that when the exhaust gas flows into the mixture part 7 of the first discharge pipe 3, a part thereof is mixed with the outside air and flows to a side of the intake passage 12 as described above, while the most part thereof is introduced into the exhaust discharge passage 4 of the second discharge pipe 13 placed as facing the small diameter part 5 and exhausted to the exterior.

Upon moving the second discharge pipe 13 in a direction close to the small diameter part 5, the exhaust introduction passage 2 and the exhaust discharge passage 4 come close to each other, thereby rendering the mixture part 7 short, and thus the exhaust gas from the exhaust introduction passage 2 passes at high speed through the inside of the mixture part 7 to be introduced into the inside of the exhaust discharge passage 4, so that the rate of the exhaust gas mixed with the outside air inside the mixture part 7 becomes high, and the EGR ratio of the intake air to be returned to the side of the intake manifold heightens. Conversely, upon moving the second discharge pipe 13 in a separating direction of the small diameter part 5, the exhaust introduction passage 2 and the exhaust discharge passage 4 come away from each other, thereby rendering the mixture part 7 long, and thus transit time of the exhaust gas in the mixture part 7 becomes longer, so that the mixing rate of the exhaust gas reduces, and the EGR ratio in the intake air to be returned to the side of the intake manifold becomes low.

As described above, in the second embodiment also, the EGR system having both the supercharging system and the EGR gas cooler function can be obtained with the simple structure and the plain manufacturing art, and thus it becomes possible to reduce the product costs, to improve the product durability, and to improve the layout property of the product for reduction in size and weight.

In the second embodiment also, the inside of the first discharge pipe 3 may be set as the exhaust discharge passage 4 upon connecting the first discharge pipe 3 to the side of the muffler while the inside of the second discharge pipe 13 is set as the intake passage 12 upon connecting the second discharge pipe 12 to the side of the intake manifold.

The Third Embodiment

Figure 4:
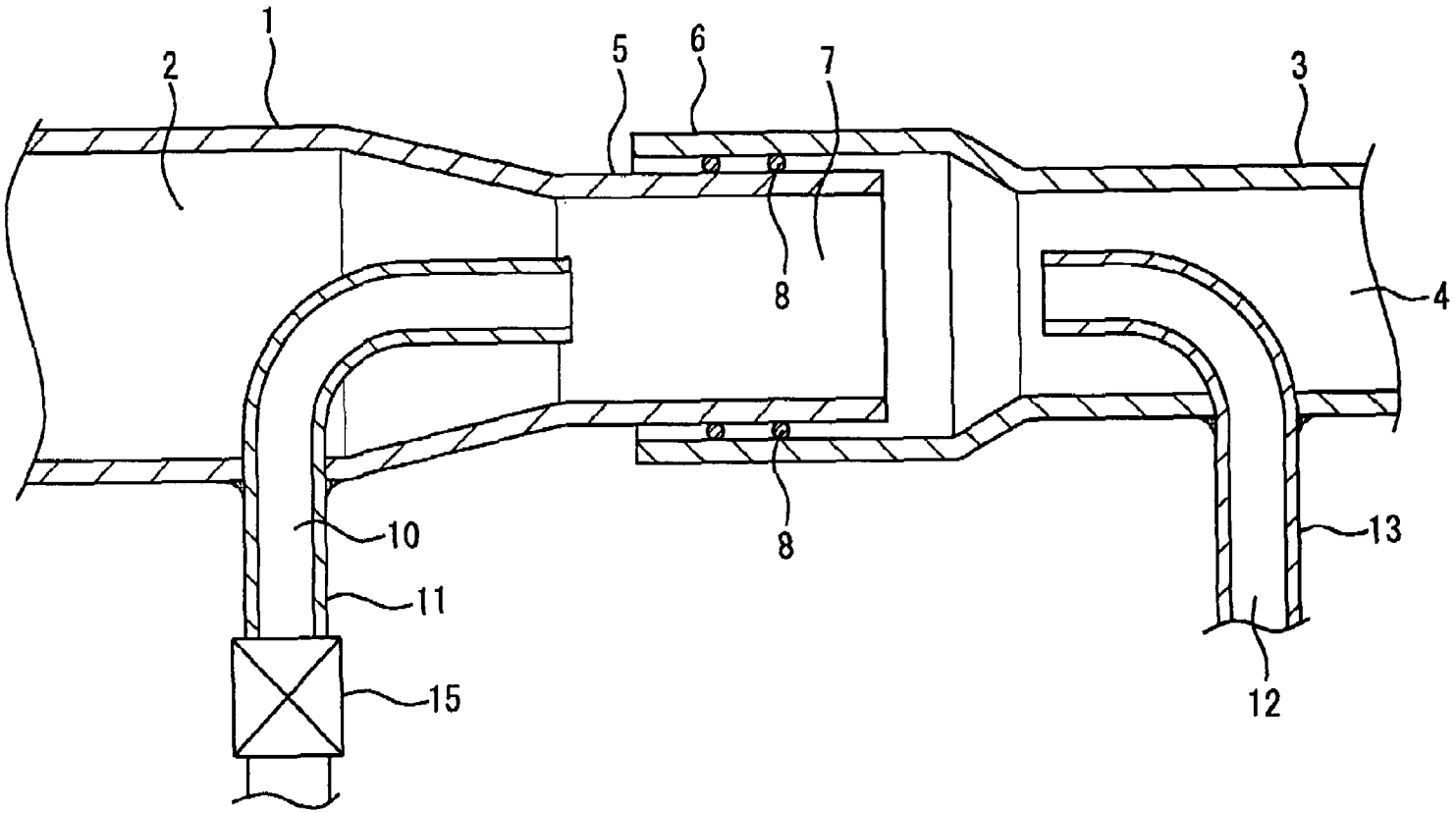
FIG. 4 is a cross-sectional view showing an EGR system wherein an air cooler is arranged to an absorption pipe according to the third embodiment of this invention.

According to the above described first embodiment, the exhaust gas can be cooled down since that the absorption pipe 11 is disposed as penetrating and inserted inside the exhaust introduction pipe 1, and the outside air absorbed into the absorption passage 10 arranged to the absorption pipe 11 is supplied to the inside of the mixture part 7 to be mixed with the exhaust gas inside the mixture part 7, however, according to the third embodiment of this invention, as shown in FIG. 4, the absorbed outside air can be previously cooled down upon arranging an air cooler 15 to the absorption passage 10, and the cooling effect on the exhaust gas inside the mixture part 7 can be further enhanced upon supplying the cooled outside air into the inside of the mixture part 7.

The third embodiment is described in reference to FIG. 4, in which the air cooler 15 is arranged to a proximal end side of the absorption pipe 11 projecting from the exhaust introduction pipe 1 to the exterior. By arranging the air cooler 15 as described above, the outside air absorbed through the proximal end of the absorption passage 10 can be cooled down with the air cooler 15 before supplied to the inside of the mixture part 7 of the exhaust introduction pipe 1. The outside air cooled down in this way is supplied to the inside of the mixture part 7 to be mixed with the exhaust gas inside the mixture part 7, and thus the mixed gas is cooled dawn. Therefore, volume of the mixed gas does not expand, so that the filling efficiency of the mixed gas inside the mixture part 7 can be excellently maintain.

Additionally, since the mixed gas can be cooled down as described above, the EGR gas cooler, the intercooler, or the like does not need to be formed separately, or even where formed, the size can be reduced considerably compared with the conventional coolers, so that the EGR system can be simplified in the structure and reduced in sized and weight. Furthermore, it is preferable that the air cooler 15 has a dehumidification function, since the outside air can be dehumidified as well as cooled down, thereby not causing dew condensation onto the inside of, e.g., the absorption pipe 11, the exhaust introduction pipe 1, or the like through which the outside air passes, and therefore the durability and reliability of the component parts of the engine is enhanced upon preventing absorption pipe 11, the exhaust introduction pipe 1, or the like from deteriorating due to rust while upon preventing the ingression of condensate liquid having high corrosion into a combustion chamber.

The Fourth Embodiment

Figure 5:
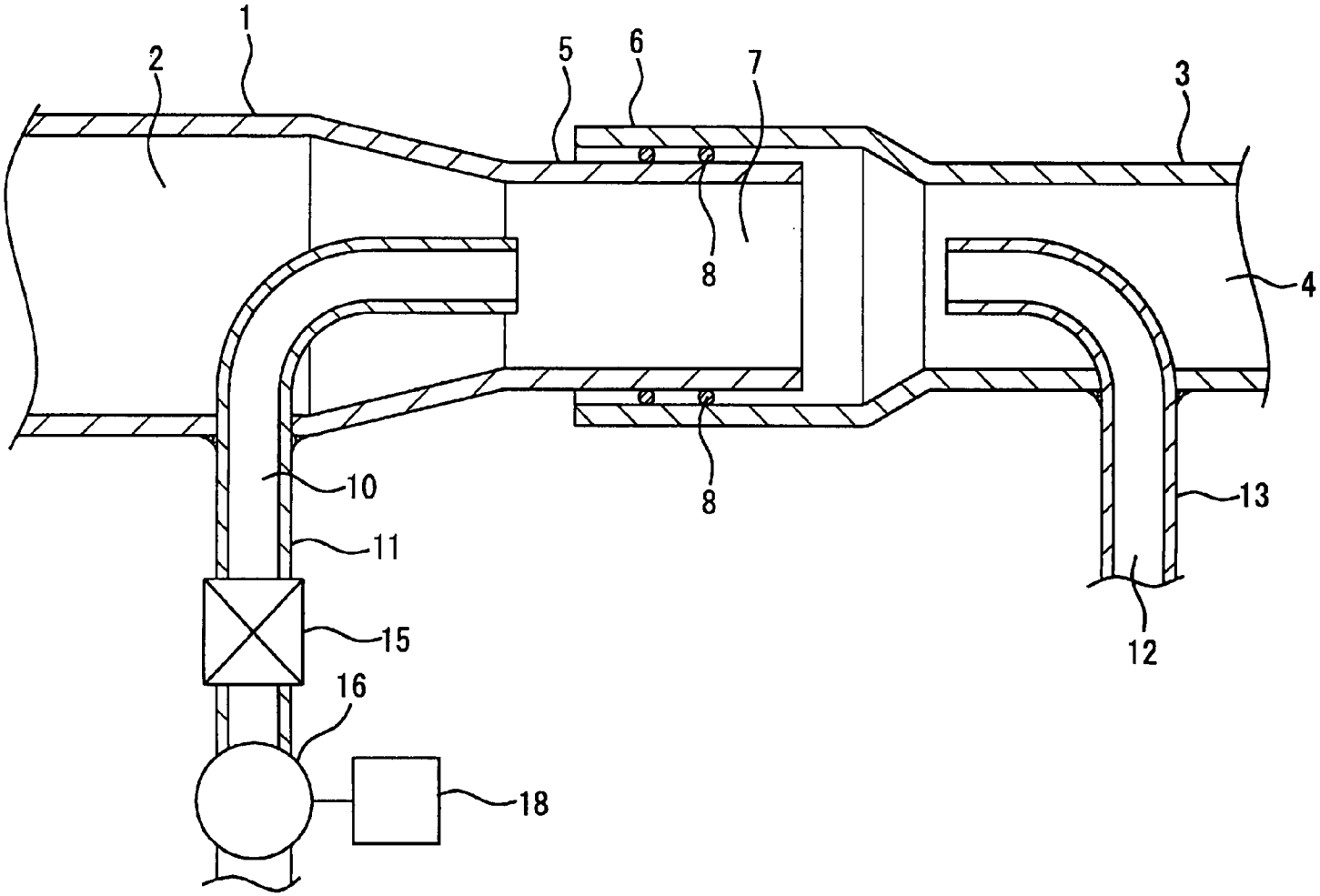
FIG. 5 is a cross-sectional view showing an EGR system wherein an absorption compressor is arranged to an absorption pipe according to the fourth embodiment of this invention.

According to the above described third embodiment, only the air cooler 15 is arranged to the absorption pipe 11, however, according to the fourth embodiment of this invention, the air cooler 15 and a compressor 16 are arranged to the absorption pipe 11. The fourth embodiment of this invention is described in reference to FIG. 4 and FIG. 5, in which the air cooler 15 is arranged to the absorption pipe 11 likewise the third embodiment, and further the compressor 16 is arranged to the proximal end portion side of the absorption pipe 11, positioned to the opposite side of a connecting side in connection with the exhaust introduction pipe 1. Furthermore, a pulley 18 is arranged to the compressor 16, in which the pulley 18 is connected to a driving member in auxiliary machinery of the internal combustion engine, and driven with the driving member in the auxiliary machinery, thereby enabling the compressor 16 to operate in accordance with rotation of the engine.

It is to be noted that in this embodiment, as described above, the compressor 16 arranged to the absorption pipe 11 is driven upon connected through the pulley 18 to the driving member in the auxiliary machinery of the internal combustion engine, however, in another different embodiment, a motor 17 may be installed to the compressor 16 to enable the compressor 16 to operate.

Upon arranging the compressor 16 to the absorption pipe 11, the outside air delivered to the inside of the mixture part 7 is compressed to become high pressure, so that more outside air of higher pressure can be delivered to the inside of the mixture part 7 compared with a case where the compressor 16 is not arranged. Furthermore, the temperature in the mixed gas can be rendered low while the intake air to be returned to the intake manifold can be supercharged with high pressure, and thus the improvement of the efficiency such as, e.g., increase of output power on the engine, upgrade of torque, or the like, can be intended.

The Fifth Embodiment

Figure 6:
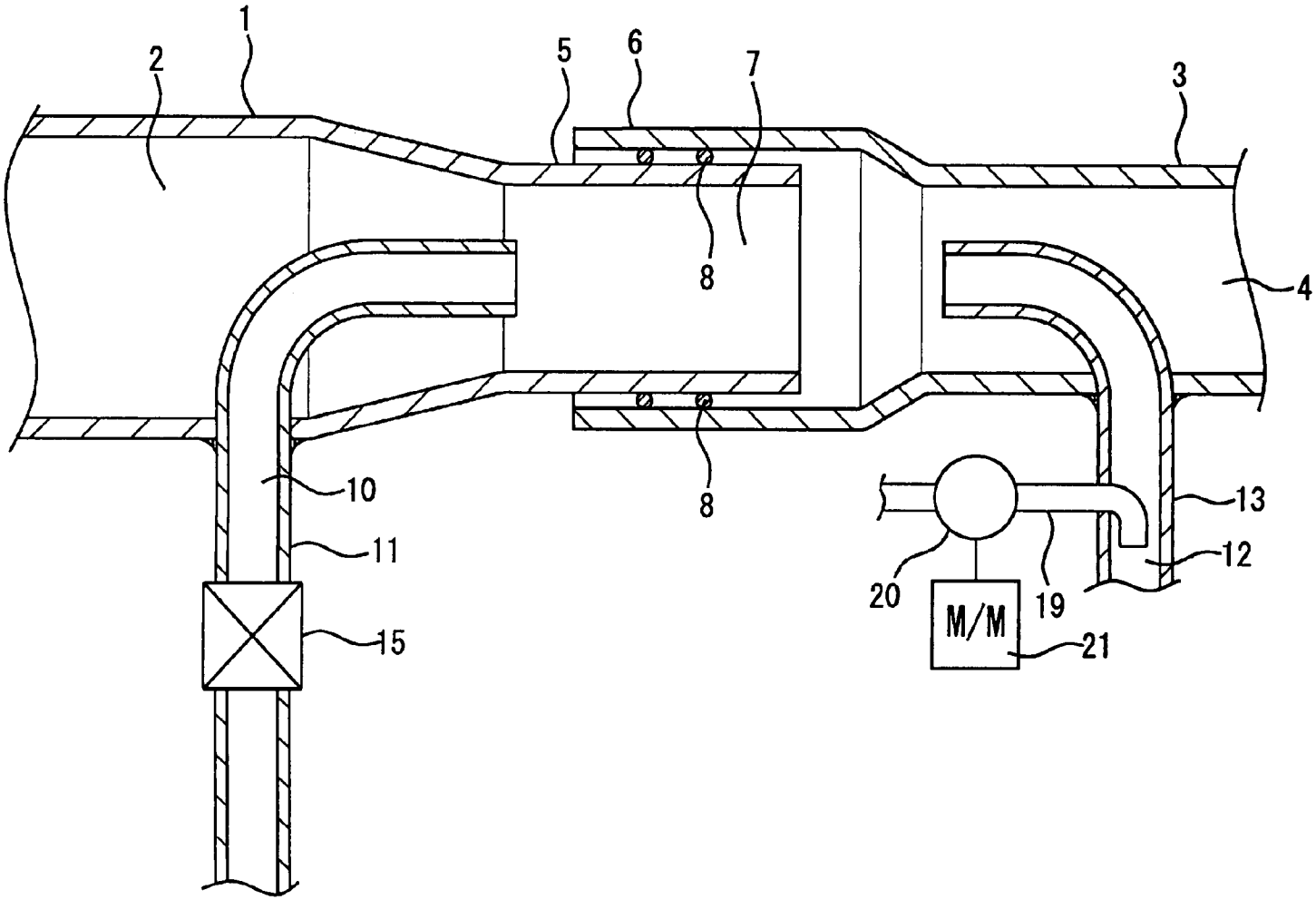
FIG. 6 is a cross-sectional view showing an EGR system wherein an intake compressor is arranged to a pressurized air introduction pipe according to the fifth embodiment of this invention.

With the EGR system according to the above described fourth embodiment, the outside air only is pressurized upon arranging the compressor 16 onto the absorption pipe 11, however, according to the fifth embodiment, a compressor 20 is arranged to a pressurized air introduction pipe 19 installed to the second discharge pipe 13. The fourth embodiment of this invention is described in reference to FIG. 6, in which the pressurized air introduction pipe 19 is arranged in a manner that a front end thereof penetrates as inserted into the inside of the second discharge pipe 13, and the compressor 20 is connected to the pressurized air introduction pipe 19. The outside air introduced from the pressurized air introduction pipe 19 is pressurized with the compressor 20, and thereafter the outside air of high pressure is ejected into the mixed gas which flowed from the mixture part 7 into the intake passage 12, thereby being supplied to the intake manifold. Upon ejecting the compressed outside air of high pressure into the mixed gas as described above, the inside of the intake passage 12 becomes under positive pressure, not under negative pressure, so that much more mixed gas can be supplied from the inside of the mixture part 7 through the intake manifold to an inside of the combustion chamber.

Furthermore, a motor 21 is installed to the compressor 20 placed to a side of the pressurized air introduction pipe 19, in which the motor 21 enables the compressor 20 to operate. It is to be noted that in this embodiment, the compressor 20 placed to the side of the pressurized air introduction pipe 19 is operated with the motor 21, but another different embodiment is not limited to this way, so the compressor 20 may be operated upon connected through the pulley 18 to the driving member in the auxiliary machinery of the internal combustion engine. Additionally, as described above, the compressor 20 is arranged to only the side of the pressurized air introduction pipe 19 according to the fifth embodiment, however, the compressors 16, 20 may be respectively arranged to the side of the pressurized air introduction pipe 19 and a side of the absorption pipe 11 according to another different embodiment.

The Sixth Embodiment

According to the first, third, fourth, and fifth embodiments, the first discharge pipe 3 is connected as not united with the exhaust introduction pipe 1 to the front end of the exhaust introduction pipe 1 while the absorption pipe 11 penetrates as inserted into a side of the exhaust introduction pipe 1, however, according to the sixth embodiment, the exhaust introduction pipe 1 and the first discharge pipe 3 are formed as a united body while the front end of the absorption pipe 11 penetrates as inserted between the exhaust introduction pipe 1 and the first discharge pipe 3.

Figure 7:
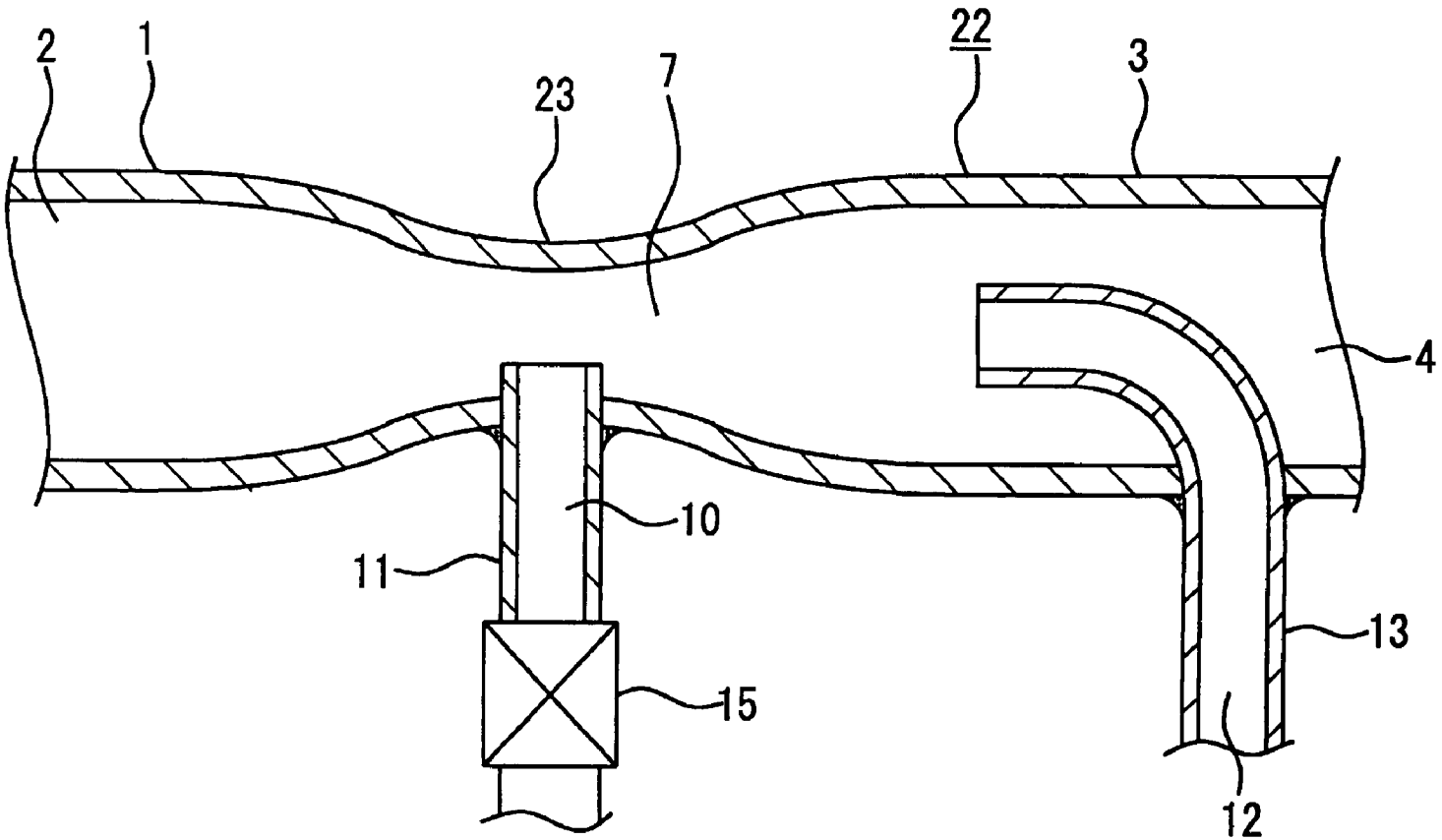
FIG. 7 is a cross-sectional view showing an EGR system arranged with a supercharging system according to the sixth embodiment of this invention.

The sixth embodiment of this invention is described in reference to FIG. 7, in which one side of a pipe body 22 in the circular cylinder shape is set as the exhaust introduction pipe 1 while the other side thereof is set as the first discharge pipe 3 so that the exhaust introduction pipe 1 and the first discharge pipe 3 are formed as united. The exhaust introduction pipe 1 and the first discharge pipe 3 are rendered approximately same in the inner diameter while the inner diameter of a middle portion between the exhaust introduction pipe 1 and the first discharge pipe 3 is formed as gradually rendered smaller as well as formed as gradually rendered larger to arrange a venturi part 23. As described above, upon forming the exhaust introduction pipe 1 and the first discharge pipe 3 as a united body, the products can be obtained with the simple structure and the plain manufacturing art, so that the manufacturing costs can be reduced and the layout property can be improved for reduction in size and weight. According to this embodiment, an interval between the absorption pipe 11 and the second discharge pipe 13, placed inside the pipe body 22 is set as the mixture part 7.

According to the first, third, fourth, and fifth embodiments, the absorption pipe 11 having the front end in the letter R shape is rendered to face the mixture part 7 and to penetrate as inserted into the exhaust introduction pipe 1, however, according to the sixth embodiment, as shown in FIG. 7, the absorption pipe 11 is not bent but the front end thereof is rendered to penetrate as inserted in a direction perpendicular to the pipe body 22 into the venturi part 23 of the pipe body 22, thereby rendering the outside air flow perpendicularly to a flowing direction of the exhaust gas. In manufacturing, therefore, the absorption pipe 11 can be easily installed to the mixture part 7.

As shown in FIG. 7, the outside air can be cooled down upon arranging the air cooler 15 to the proximal end side of the absorption pipe 11, so that the filling efficiency for the mixed gas can be more excellently improved upon further enhancing the cooling effect on the mixed gas. It is to be noted that in this embodiment, the EGR ratio in the mixed gas can be adjusted arbitrarily upon changing the absorption amount of the outside air through the absorption passage 10.

The Seventh Embodiment

According to the sixth embodiment, as described above, since the second discharge pipe 13 is connected as fastened to the pipe body composed of the exhaust introduction pipe 1 and the first discharge pipe 3 formed as a united body, the formation length of the mixture part 7 inside the pipe body, between the absorption pipe 11 and the second discharge pipe 13 is held constant, however, according to the seventh embodiment, the third discharge pipe 24 connected as fastened to the second discharge pipe 13 is connected to the pipe body 22 as a non-united body, thereby rendering the formation length of the mixture part 7 adjustable. The seventh embodiment is described in reference to FIG. 8, in which the inner diameter of the third discharge pipe 24 is rendered lager than the outer diameter of a front end part 25 of the first discharge pipe 3 side of the pipe body 22, and the front end part 25 of the pipe body 22 is inserted into one end of the third discharge pipe 24, thereby connecting the third discharge pipe to the pipe body 22.

Figure 8:
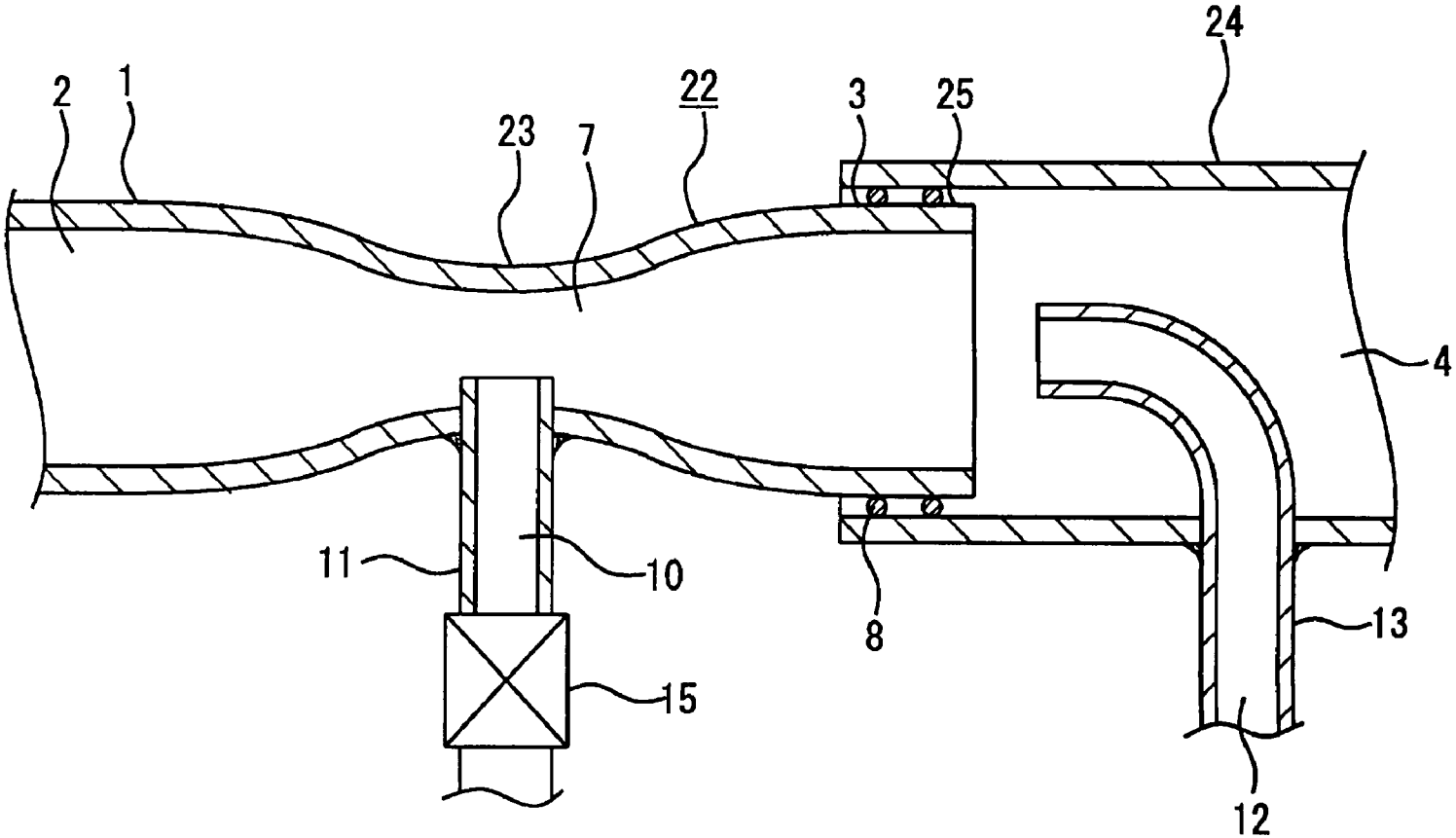
FIG. 8 is a cross-sectional view showing an EGR system arranged with a supercharging system according to the seventh embodiment of this invention.

The second discharge pipe 13 is arranged to the third discharge pipe 24, and a connecting part between the third discharge pipe 24 and the pipe body 22 is not fastened, thereby being respectively arbitrarily movable in the pipe axis direction. Thus, the formation length of the mixture part 7 between the absorption pipe 11 arranged to the pipe body 22 and the second discharge pipe 13 arranged to the third discharge pipe 24 can be arbitrarily adjusted upon moving the third discharge pipe 24 and the pipe body 22 in the axis pipe direction, so that the adjustment of the EGR ratio can be conducted easily. Furthermore, as shown in FIG. 8, the airtight member 8 is disposed between the outer circumference of the front end part 25 of the pipe body 22 and the inner circumference of the third discharge pipe 24 to prevent the gas leak, the friction on the pipes as well as to enhance the stability of the connection between the pipe body 22 and the third discharge pipe 24.

The mixture part 7 for mixing the outside air with the exhaust gas is arranged inside the space composed of the small diameter part 5 of the exhaust introduction pipe 1 and the insertion part 6 of the first discharge pipe 3 in the first, third, fourth, fifth embodiments; is arranged as not united with the small diameter part 5, inside the first discharge pipe 3 in the second embodiment; is arranged inside the pipe body 22, between the absorption pipe 11 and the second discharge pipe 13 in the sixth embodiment; and is arranged between the absorption pipe 11 inside the pipe body 22 and the second discharge pipe 13 inside the third discharge pipe 24 in the seventh embodiment, however, the mixture part 7 may be arranged to any position between the exhaust introduction passage 2 and the exhaust discharge passage 4 under conditions where the flowing velocity of the exhaust gas is accelerated with the small diameter part 5 to change the internal pressure into the negative pressure, thereby being able to absorb the outside door.

In the seventh embodiment, likewise the above described second embodiment, the third discharge pipe 24 may be bent as formed in a substantially letter L shape, and the second discharge pipe 13 may be inserted as disposed to around this bent part. Furthermore, likewise the fourth embodiment, the outside air to be delivered into the mixture part 7 may be compressed upon forming the compressor 16 to the absorption pipe 11 or likewise the fifth embodiment, the compressor 20 may be arranged to the second discharge pipe 13 through the compressed air introduction pipe 19 to eject the outside air of high pressure compressed with the compressor 20 into the mixed gas.

In each of the above described embodiments, this invention is applied to the EGR system for automobiles for recirculating the exhaust gas from the engine, but can be applied to diesel engines or other internal combustion engines for marine vessels, electric power generation, construction machinery, agricultural machinery, or the like.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A supercharging system for the internal combustion engine, comprising:

an exhaust introduction passage for introducing exhaust gas from an internal combustion engine;

an exhaust discharge passage for receiving the exhaust gas from the exhaust introduction passage and exhausting the exhaust gas to an exterior;

a mixture part arranged between the exhaust introduction passage and the exhaust discharge passage, for changing internal pressure into negative pressure upon accelerating flowing velocity of the exhaust gas with a narrowed flowing passage set to have a smaller diameter than that of the exhaust introduction passage;

an absorption passage for mixing outside air and the exhaust gas inside the mixture part upon introducing the outside air with use of the negative pressure into an inside of the mixture part;

an intake passage for taking out and returning a part of mixed gas mixed inside the mixture part to the internal combustion engine; and a formation length of the mixture part being adjustable such that the exhaust introduction passage and the exhaust discharge passage are movable relative one another in a direction coming close to or separating from each other.

2. The supercharging system for the internal combustion engine according to claim 1, wherein:

a small diameter part is a front end side of an exhaust introduction pipe forming the exhaust introduction passage, wherein the small diameter part is coupled at a coupling part to a first discharge pipe forming the flowing passage for the exhaust gas, an inside of the coupling part is set as the mixture part for mixing the exhaust gas and the outside air, an absorption pipe forming the absorption passage opening on an upstream side of the mixture part is disposed penetrating and inserted into the exhaust introduction pipe, a second discharge pipe forming the flowing passage for introducing a part of the mixed gas mixed in the mixture part is disposed on a downstream side of the mixture part, penetrating and inserted into the first discharge pipe, and one flowing passage of either the first or second discharge pipe is set as the exhaust discharge passage for exhausting the mixed gas to the exterior, while the other flowing passage is set as an intake passage for returning the mixed gas to a side of the internal combustion engine.

3. The supercharging system for the internal combustion engine according to claim 2, wherein the coupling part between the exhaust introduction pipe and the first discharge pipe is set as an absorption passage with a gap part in communication with the exterior, introducing the outside air into the mixture part.

4. A supercharging system for the internal combustion engine, comprising:

an exhaust introduction passage for introducing exhaust gas from an internal combustion engine;

an exhaust discharge passage for receiving the exhaust gas from the exhaust introduction passage and exhausting the exhaust gas to an exterior;

a mixture part arranged between the exhaust introduction passage and the exhaust discharge passage, for changing internal pressure into negative pressure upon accelerating flowing velocity of the exhaust gas with a narrowed flowing passage set to have a smaller diameter than that of the exhaust introduction passage;

an absorption passage for mixing outside air and the exhaust gas inside the mixture part upon introducing the outside air with use of the negative pressure into an inside of the mixture part;

an intake passage for taking out and returning a part of mixed gas mixed inside the mixture part to the internal combustion engine; and a small diameter part is a front end side of an exhaust introduction pipe forming the exhaust introduction passage, wherein the small diameter part is coupled at a coupling part to a first discharge pipe forming the flowing passage for the exhaust gas, wherein an inside of the coupling part is set as the mixture part for mixing the exhaust gas and the outside air, wherein an absorption pipe forming the absorption passage opening on an upstream side of the mixture part is disposed penetrating and inserted into the exhaust introduction pipe, wherein a second discharge pipe forming the flowing passage for introducing a part of the mixed gas mixed in the mixture part is disposed on a downstream side of the mixture part, penetrating and inserted into the first discharge pipe, and wherein one flowing passage of either the first or second discharge pipe is set as the exhaust discharge passage for exhausting the mixed gas to the exterior, while the other flowing passage is set as an intake passage for returning the mixed gas to a side of the internal combustion engine.

5. The supercharging system for the internal combustion engine according to claim 4, wherein the coupling part between the exhaust introduction pipe and the first discharge pipe is set as an absorption passage with a gap part in communication with the exterior introducing the outside air into the mixture part.

* * * * *